US009297193B1

(12) United States Patent
Martin

(10) Patent No.: US 9,297,193 B1
(45) Date of Patent: Mar. 29, 2016

(54) DOOR OPENER AID

(71) Applicant: James Bell Martin, Brentwood, TN (US)

(72) Inventor: James Bell Martin, Brentwood, TN (US)

( * ) Notice: Subject to any disclaimer, the term of this patent is extended or adjusted under 35 U.S.C. 154(b) by 0 days.

(21) Appl. No.: 14/827,296

(22) Filed: Aug. 15, 2015

(51) Int. Cl.
*E05F 1/14* (2006.01)
*E05F 1/12* (2006.01)
*E05D 3/02* (2006.01)
*E05D 7/10* (2006.01)

(52) U.S. Cl.
CPC ..... *E05F 1/1207* (2013.01); *E05D 3/022* (2013.01); *E05D 7/1005* (2013.01); *E05D 2007/1027* (2013.01)

(58) Field of Classification Search
CPC ..... E05D 3/02; E05D 11/00; E05D 3/022; E05D 7/1005; E05D 2007/1027; E05F 1/1207
USPC ..... 16/295, 285, 307, 373
See application file for complete search history.

(56) References Cited

U.S. PATENT DOCUMENTS

| | | | | |
|---|---|---|---|---|
| 926,520 | A * | 6/1909 | Thornton et al. | 16/50 |
| 1,215,498 | A | 2/1917 | Dietz | |
| 1,925,945 | A | 9/1933 | Levinson | |
| 2,037,411 | A | 4/1936 | Fay | |
| 2,807,043 | A | 9/1957 | Gordon | |
| 3,329,991 | A | 7/1967 | Lew | |
| 5,191,678 | A * | 3/1993 | Firari | 16/305 |
| 5,320,333 | A * | 6/1994 | Koch | 267/155 |
| 5,649,339 | A | 7/1997 | Reed | |
| 5,826,306 | A * | 10/1998 | Faubert et al. | 16/244 |
| 6,553,623 | B2 | 4/2003 | Long | |
| 6,931,691 | B1 * | 8/2005 | Ward | 15/250.351 |
| 7,520,022 | B2 | 4/2009 | Conway | |
| 7,730,584 | B2 * | 6/2010 | Duffy | 16/304 |
| 2003/0014839 | A1 * | 1/2003 | Wu | 16/298 |

FOREIGN PATENT DOCUMENTS

| | | |
|---|---|---|
| AU | 8437159 | 12/1984 |
| WO | WO 2008117764 A1 * | 10/2008 |

* cited by examiner

*Primary Examiner* — Jerry Redman
(74) *Attorney, Agent, or Firm* — Shane V. Cortesi

(57) ABSTRACT

The present invention relates to a torsion spring that has a proximal leg with a proximal segment and a distal segment, a distal leg with a proximal segment and a distal segment, and a coil between the proximal and distal legs. The torsion spring is preferably used adjacent to a door hinge to bias the door in an open position. The proximal segment of the proximal leg and the distal segment of the distal leg are preferably curved so that they may be hammered into the door and door frame in order to keep the torsion spring in place.

18 Claims, 6 Drawing Sheets

DOOR OPENER AID

BACKGROUND

1. Technical Field

The present invention relates to devices that assist in opening and holding open an unlatched door.

2. Background of the Invention

Unlatched doors that remain closed represent a minor nuisance to many people but are especially problematic for elderly and disabled people using wheel chairs and walkers and are also a nuisance in such examples as a bathroom door that is unlatched but remains closed so that it can not be seen that the bathroom is unused, and when ventilation is desired through the door opening.

U.S. Pat. No. 6,553,623 (the '623 patent) teaches a spring door opener comprising a helical torsion spring coil body with two legs extending therefrom. One of the legs contains two substantially 90-degree bends such that the legs are configured to exit the coil body on the same side. The door opener is attached to the hinge pin on a door hinge to maintain a door in an open position. The legs are designed to rest flush against the door and the door frame.

It is believed that the system of the '623 patent would be prone to moving on the door and door frame and cause the hinge pin to pull out during frequent opening and closing of the hinge.

Thus, there is a continuing need for devices that assist in opening and holding open or at least partially open an unlatched door.

BRIEF SUMMARY

The present disclosure provides a door opener system.

In some embodiments, the door opener system is used in a method that comprises: a) providing a door frame comprising a plurality of sides and a door opening located between the plurality of sides; b) providing a door comprising a plurality of sides, the door configured to pivot along a pivot axis from a closed position in which the door covers the door opening to an open position in which the door does not cover the door opening; c) providing a door hinge comprising a door plate attached to a side of the door, a frame plate attached to a side of the frame adjacent to the door when the door is in the closed position, a pin aperture located between the door plate and the frame plate, and a pivot pin configured to be removably inserted through the pin aperture, the pivot pin and pivot aperture generally parallel to the pivot axis; d) removing the pivot pin from the door hinge; e) providing a torsion spring comprising a proximal leg comprising a proximal segment and a distal segment, a distal leg comprising a proximal segment and a distal segment, and a coil located between the proximal segment of the distal leg and the distal segment of the proximal leg, the coil comprising a plurality of runs, the plurality of runs creating an aperture, the proximal segment of the proximal leg forming approximately a 90 degree angle with the respect to the distal segment of the proximal leg, the distal segment of the distal leg forming approximately a 90 degree angle with respect to the proximal segment of the distal leg, the torsion spring having a relaxed state and a compressed state; f) inserting the pivot pin through the aperture created by the plurality of runs and into the pivot pin aperture; and g) forcing the distal segment of the distal leg into a side of the door and adjacent to the door plate and forcing the proximal segment of the proximal leg into the frame adjacent to the frame plate.

Optionally, the proximal segment of the proximal leg and the distal segment of the distal leg point in generally the same direction when the torsion spring is in the relaxed state. Optionally, the proximal and distal segments of the proximal leg and the proximal and distal segments of the distal leg are generally straight. Optionally, the proximal segment of the proximal leg is shorter than the distal segment of the proximal leg and further wherein the distal segment of the distal leg is shorter than the proximal segment of the distal leg. Optionally, the proximal segment of the proximal leg and the distal segment of the distal leg point in opposite directions when the door is in the closed position. Optionally, step g) comprises hammering the distal segment of the distal leg into the side of the door that is affixed to the door plate and hammering the proximal segment of the proximal leg into the side of the frame that is affixed to the frame plate. Optionally, step g) comprises forcing the distal segment of the distal leg into the door above the door plate and forcing the proximal segment of the proximal leg into the door frame above the frame plate. Optionally, the coil is generally cylindrical in shape. Optionally, the torsion spring is comprised of a continuous piece of metal wire from the proximal segment of the proximal leg to the distal segment of the distal leg. Optionally, the continuous piece of metal wire has a diameter of from about 0.045 inches to about 0.065 inches. Optionally, the torsion spring comprises a length of between about 2 and about 3 inches. Optionally, the torsion spring is comprised of a continuous piece of tempered spring wire from the proximal segment of the proximal leg to the distal segment of the distal leg, the continuous piece of tempered spring wire having a length of from about 4 inches to about 7 inches. Optionally, after step g), the torsion spring is configured to bias the door in the open position. Optionally, after step g), the torsion spring is in the compressed state when the door is in the closed position. Optionally, the method further comprises providing a washer comprising a washer aperture, the washer aperture comprising a diameter, and step f) comprises inserting the pivot pin first through the washer aperture, then through the aperture created by the plurality of runs and then into the pivot pin aperture. Optionally, the washer aperture is generally circular in shape and has a diameter, the aperture created by the plurality of runs is generally circular in shape and has a diameter and further wherein the diameter of the washer aperture is less than the diameter of the aperture created by the plurality of runs. Optionally, the aperture created by the plurality of runs has a diameter of between about 0.5 and about 0.75 inches. Optionally, the torsion spring comprises a top run, a bottom run, a height extending from the top run to the bottom run, and further wherein one of the proximal and distal legs extends from the top run and the other of the proximal and distal legs extends from the bottom run.

In some embodiments, the present invention provides a door spring kit comprising: a) a proximal leg comprising a proximal segment and a distal segment, a distal leg comprising a proximal segment and a distal segment, and a coil between the proximal and distal legs, the coil comprising a plurality of runs, the plurality of runs creating an aperture, the proximal segment of the proximal leg forming approximately a 90 degree angle with the respect to the distal segment of the proximal leg, the distal segment of the distal leg forming approximately a 90 degree angle with respect to the proximal segment of the distal leg, the torsion spring having a relaxed state and a compressed state; and b) a washer comprising a washer aperture, the washer aperture generally circular in shape, wherein the diameter of the washer aperture is less than the diameter of the aperture created by the plurality of runs.

The torsion spring may have the various features recited in the previous embodiment, including without limitation the dimensions recited above, the direction in which the proximal segment of the proximal leg and the distal segment of the distal leg point, the fact that the segments may be straight, the shape of the coil, the composition and dimensions of the spring wire, and the size of the aperture created by the plurality of runs.

By using one or two of the torsions springs described herein on a door the door can be held partially or fully open when unlatched. Preferably, the torsion spring is used on a door that has two hinges or more, is wooden, and is in a wooden door frame. The torsion springs and washer are designed to fit almost any hinge pin diameter and are designed to stay in place on the hinge and not pull the pin out during door operation.

In some embodiments, the system when fully assembled includes: a) a door frame comprising a plurality of sides and a door opening located between the plurality of sides; b) a door comprising a plurality of sides, the door configured to pivot along a pivot axis from a closed position in which the door covers the door opening to an open position in which the door does not cover the door opening; c) a door hinge comprising a door plate attached to a side of the door, a frame plate attached to a side of the frame adjacent to the door plate when the door is in the closed position, a pivot pin aperture located between the door plate and the frame plate; d) a torsion spring comprising a proximal leg comprising a proximal segment and a distal segment, a distal leg comprising a proximal segment and a distal segment, and a coil located between the proximal segment of the distal leg and the distal segment of the proximal leg, the coil comprising a plurality of runs, the plurality of runs creating an aperture, the proximal segment of the proximal leg forming approximately a 90 degree angle with the respect to the distal segment of the proximal leg, the distal segment of the distal leg forming approximately a 90 degree angle with respect to the proximal segment of the distal leg, the torsion spring having a relaxed state and a compressed state; and e) a pivot pin inserted through the aperture created by the plurality of runs and into the pivot pin aperture, wherein the distal segment of the distal leg is located at least partially inside a side of the door and adjacent to the door plate and the proximal segment of the proximal leg is located at least partially inside the frame adjacent to the frame plate, and further wherein the pivot pin and pivot aperture are generally parallel to the pivot axis. Again, the system may have one or more of the features and dimensions described above.

DETAILED DESCRIPTION

Figure 1:
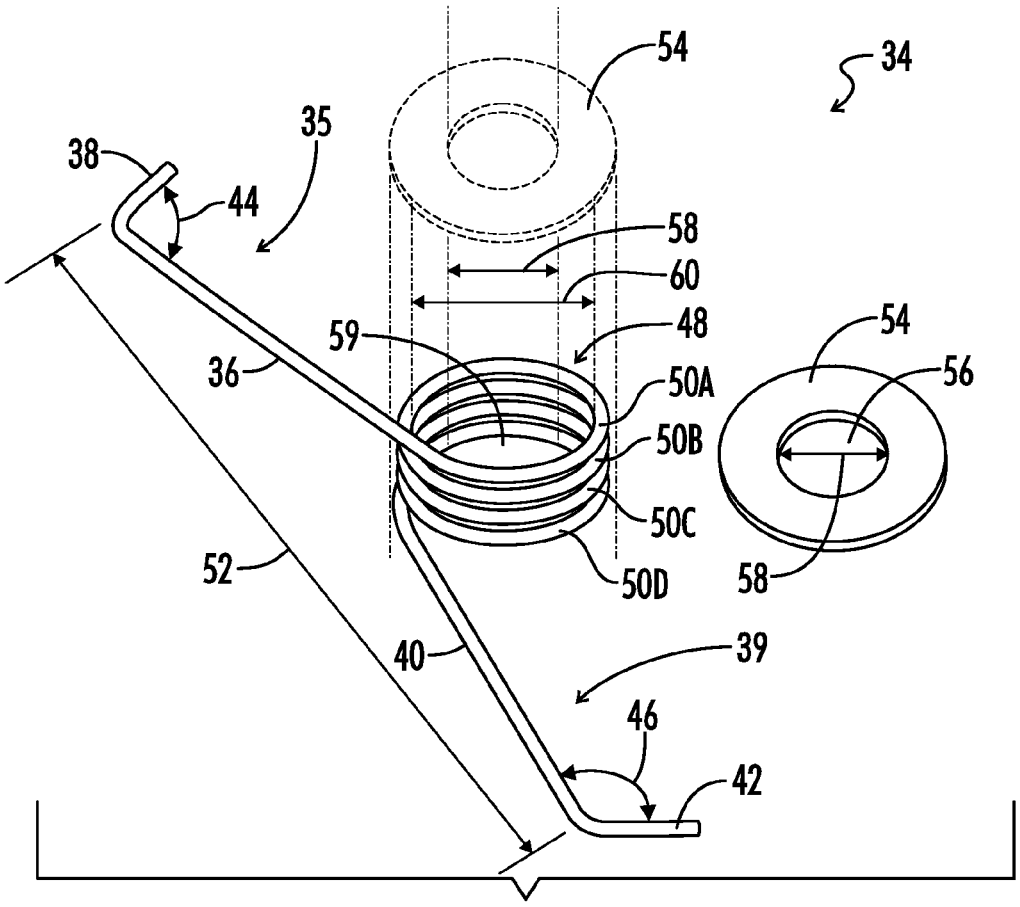
FIG. 1 illustrates a side perspective view of one embodiment of a torsion spring and washer for use in the door opener system of the present invention; the washer is shown above the torsion spring for purposes of comparing the diameter of the aperture created by the plurality of runs to the washer aperture diameter.
Figure 2:
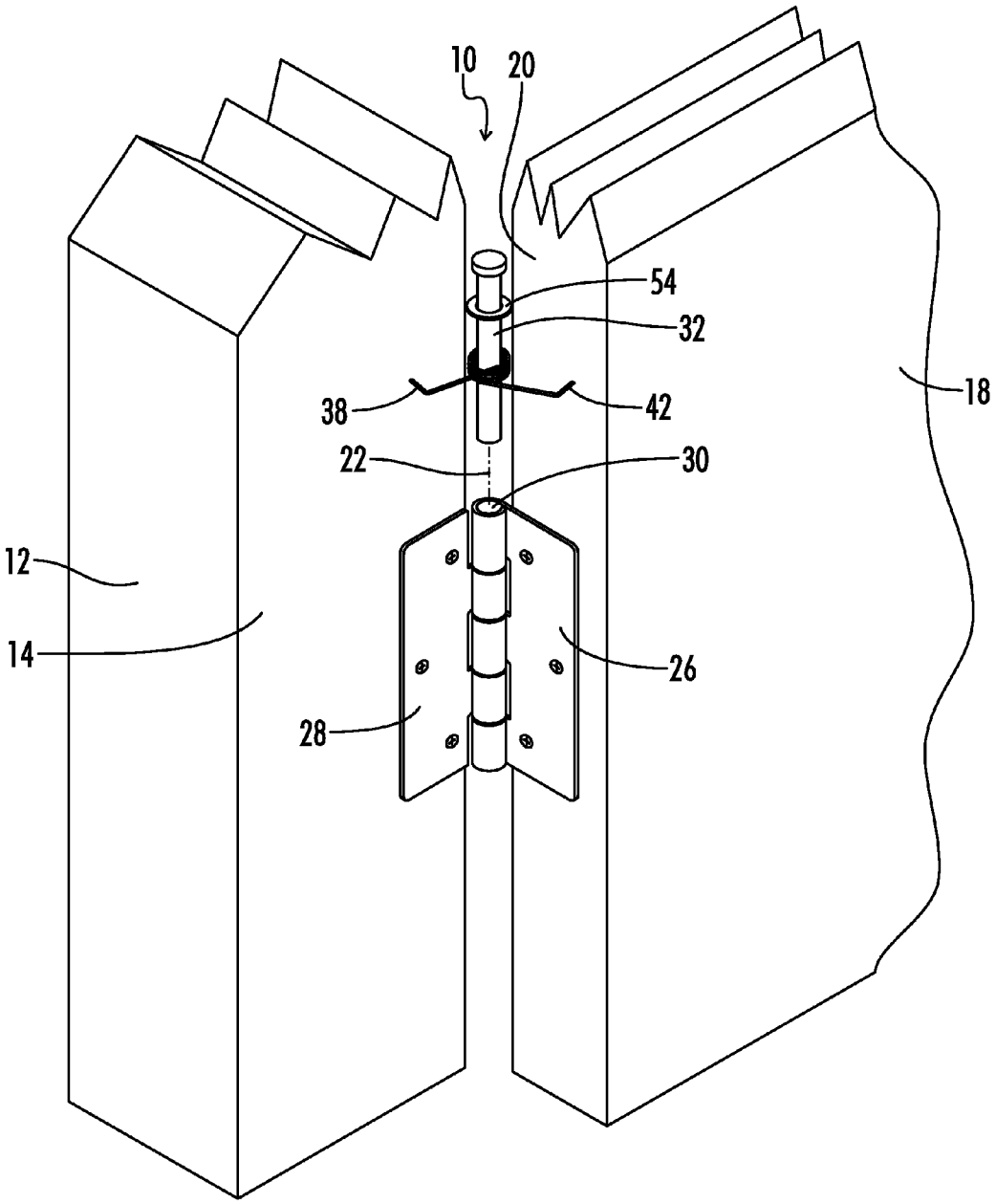
FIG. 2 illustrates an exploded, side perspective view of a door opener system of one embodiment of the present invention.

With reference to FIGS. 1-6, the present invention provides a door opener system designated by the numeral 10. In the drawings, not all reference numbers are included in each drawing for the sake of clarity.

Referring further to FIGS. 1-6, in some embodiments, the door opener system 10 includes: a) a door frame 12 comprising a plurality of sides 14 and a door opening 16 located between the plurality of sides 14; b) a door 18 comprising a plurality of sides 20, the door 18 configured to pivot along a pivot axis 22 from a closed position in which the door covers the door opening 16 and is parallel to the door frame 12 (i.e., at least partially covers the door opening 16, more preferably, substantially covers the door opening 16) to an open position in which the door 18 does not cover the door opening 16 and is for example about 90 degrees relative to the door frame 12; c) a door hinge 24 comprising a door plate 26 attached to a side 20 of the door 18, a frame plate 28 attached to a side 14 of the frame 12 adjacent to the door 18 when the door 18 is in the closed position, a pin aperture 30 located between the door plate 26 and the frame plate 28, and a pivot pin 32 configured to be removably inserted through the pin aperture 30, the pivot pin 32 and pivot aperture 30 generally parallel to the pivot axis 22; and d) a torsion spring 34 comprising a proximal leg 35 comprising a proximal segment 38 and a distal segment 36, a distal leg 39 comprising a proximal segment 40 and a distal segment 42, a coil 48 located between the distal segment 36 of the proximal leg 35 and the proximal segment 40 of the distal leg 39, the coil 48 comprising a plurality of loops/runs 50A-50D. The door 18, door frame 12 and door opening 16 may be any suitable shape. When the door 18 is in the closed position, the door plate 26 will generally face the frame plate 28.

Optionally, the door 18, door frame 12 and door opening 16 are generally rectangular in shape and the door 18 further comprises a handle (e.g., a door knob).

The proximal and distal segments 40 and 42 of the distal leg 39 and the proximal and distal segments 36 and 38 of the proximal leg 35 are preferably generally straight. Preferably, the proximal segment 38 of the proximal leg 35 forms approximately a 90 degree angle (e.g., between 60 degrees and 120 degrees) 44 with the respect to the distal segment 36 of the proximal leg 35 and the distal segment 42 of the distal leg 39 forms approximately a 90 degree angle (e.g., between 60 degrees and 120 degrees) 46 with respect to the proximal segment 40 of the distal leg 39. The proximal segment 40 of the distal leg 39 is preferably longer than the distal segment 42 of the distal leg 39 and the distal segment 36 of the proximal leg 35 is preferably longer than the proximal segment 38 of the proximal leg 35.

The pivot pin 32 is inserted through the coil loops/runs 50A-50D (more particularly through the aperture 59 created by the coil loops/runs 50A-50D) and into the pivot pin aperture 30 and, after insertion, the head of the pivot pin 32 is preferably located above the coil loops/runs 50A-50D.

The torsion spring 34 has a relaxed state and a compressed state. Preferably, the torsion spring 34 is in the relaxed state when the door 18 is in the open position and in a compressed state when the door 18 is in the closed position so that the torsion spring 34 is configured to bias the door 18 in the open position when the door 18 is unlatched (e.g., when the door knob is turned in order to move the door 18 from the closed position to the open position).

The distal segment 42 of the distal leg 39 is forced into a side 20 of the door 18 and adjacent to the door plate 26 (by, for example, hammering) and the proximal segment 38 of the proximal leg 35 is forced into the door frame 12 adjacent to the frame plate 28. Preferably, the proximal segment 38 of the proximal leg 35 and the distal segment 42 of the distal leg 39 point in generally the same direction when the torsion spring 34 is in the relaxed state—i.e., when the door 18 is in the open position and the door 18 is approximately 90 degrees relative to the door frame 12—and the proximal segment 38 of the proximal leg 35 and the distal segment 42 of the distal leg 39 point in opposite directions when the torsion spring 34 is in the compressed state—i.e., when the door 18 is in the closed position and the door 18 is generally parallel to the door frame 12.

Figure 3:
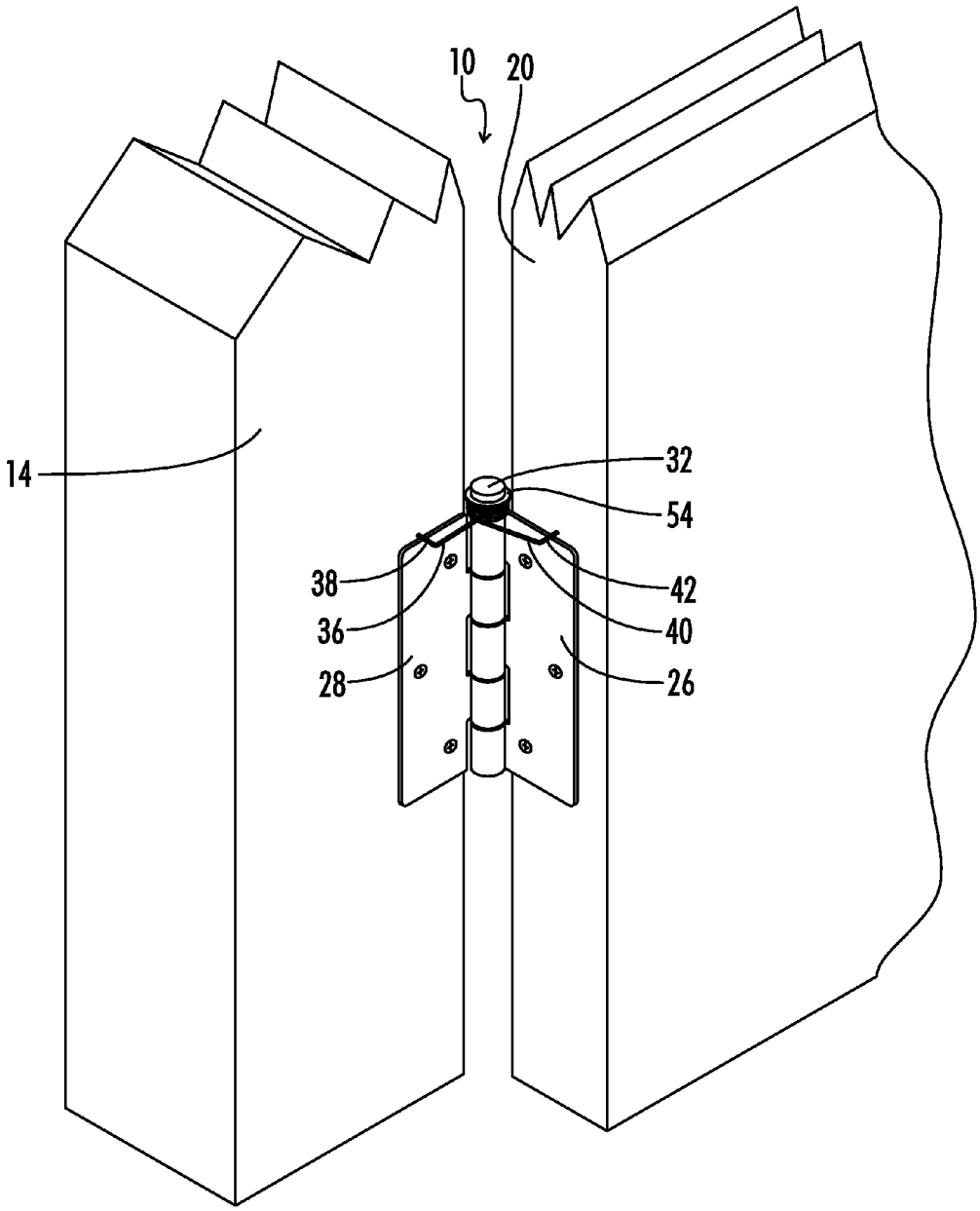
FIG. 3 illustrates a side perspective view of the door opener system of FIG. 2 before hammering the proximal segment of the proximal leg and the distal segment of the distal leg into the door and door frame.
Figure 4:
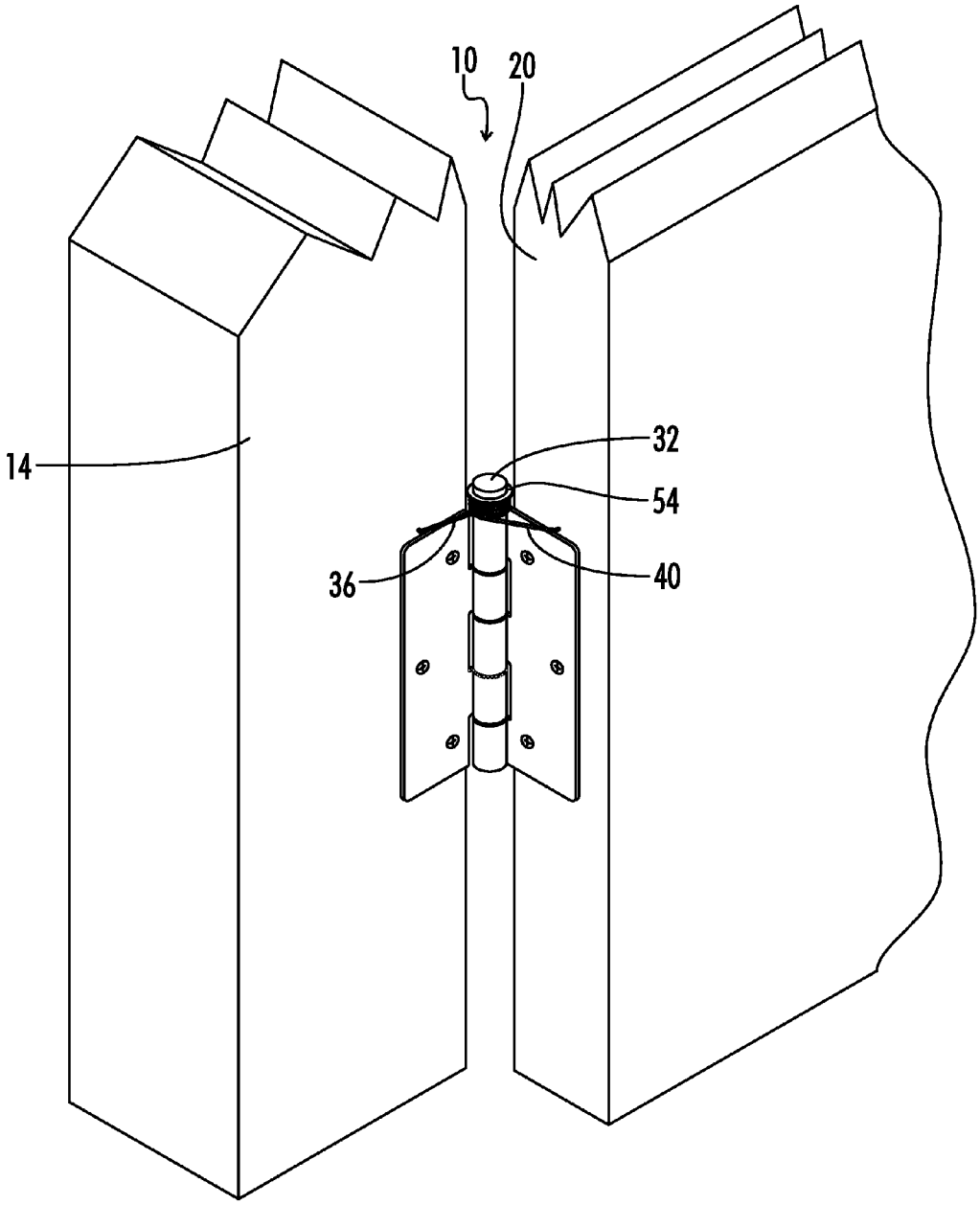
FIG. 4 illustrates a side perspective view of the door opener system of FIG. 2 after hammering the proximal segment of the proximal leg and the distal segment of the distal leg into the door and door frame.

Preferably, the proximal segment 38 of the proximal leg 35 and the distal segment 42 of the distal leg 39 are located above the door hinge 24, as best seen in FIG. 3.

Preferably, the coil 48 is generally cylindrical in shape. Preferably, the torsion spring 34 is comprised of a continuous piece of metal wire from the proximal segment 38 of the proximal leg 35 to the distal segment 42 of the distal leg 39. Optionally, the continuous piece of metal wire has a diameter of from about 0.045 inches to about 0.065 inches, which makes it easier to hammer the proximal segment 38 of the proximal leg 35 into the door frame 12 and to hammer the distal segment 42 of the distal leg 39 into the door 18, and is of sufficient strength to gently open a standard wooden door 18 (e.g., a door 18 weighing at least about 35 pounds). Optionally, the torsion spring 34 comprises a length 52 of between about 2 inches and about 3 inches—i.e., it will be understood that the length 52 is merely referring to the length of the torsion spring 34 itself, as opposed to the length of the continuous wire that comprises the torsion spring 34; the length of the continuous wire is longer due to the curved nature of the torsion spring 34 and the loops/runs 50A-50D. Optionally, the length of the continuous wire prior to winding the spring 34 to create the loops/runs 50A-50D is about 4 inches to about 7 inches, depending on the number of loops/runs 50A-50D desired. The wire used for the torsion spring 34 should be tempered spring wire. Various number of loops/runs 50A-50D may be used depending upon the spring tension desired.

In the event that the aperture 59 created by the torsion spring loops/runs 50A-50D is too wide for the pivot pin 32, a washer 54 with a circular washer aperture 56 may be provided. Optionally, the aperture 59 created by the loops/runs 50A-50D is generally circular in shape and has a diameter 60 and further wherein the diameter 58 of the washer aperture 56 is less than the diameter 60 of the aperture 59 created by the loops/runs 50A-50D and the washer 54 is located directly above the top loop/run 50A of the torsion spring 34. In other words, the surface area of the washer aperture 56 is larger than the surface area of the top of the circular aperture 59 created by the loops/runs 50A-50D, which allows the washer 54 to rest on top of the top loop/run 50A. (If a washer 54 is not used, the head of the pivot pin 32 will rest on the top loop/run 50A. If a washer 54 is used, the head of the pivot pin 32 will rest on the washer 54).

Optionally, the coil 48 is generally cylindrical in shape and comprises a diameter of between about 0.5 inches and about 0.75 inches, more particularly, the diameter of the aperture 59 created by the plurality of runs/loops 50A-50D is between about 0.5 inches and about 0.75 inches.

Optionally, the torsion spring 34 comprises a top loop/run 50A, a bottom run/loop 50D, a height extending from the top loop/run 50A to the bottom loop/run 50D, and further wherein one of the proximal and the distal legs 35 and 39 extends from the top loop/run 50A and the other of the proximal and the distal legs 35 and 39 extends from the bottom run/loop 50D, as best seen in FIG. 1.

The door opener system 10 may be provided in the form of a kit with the washer 54 packaged with the torsion spring 34 and the customer may take the kit and use the kit to retrofit his/her existing door 18 and door frame 12.

Figure 5:
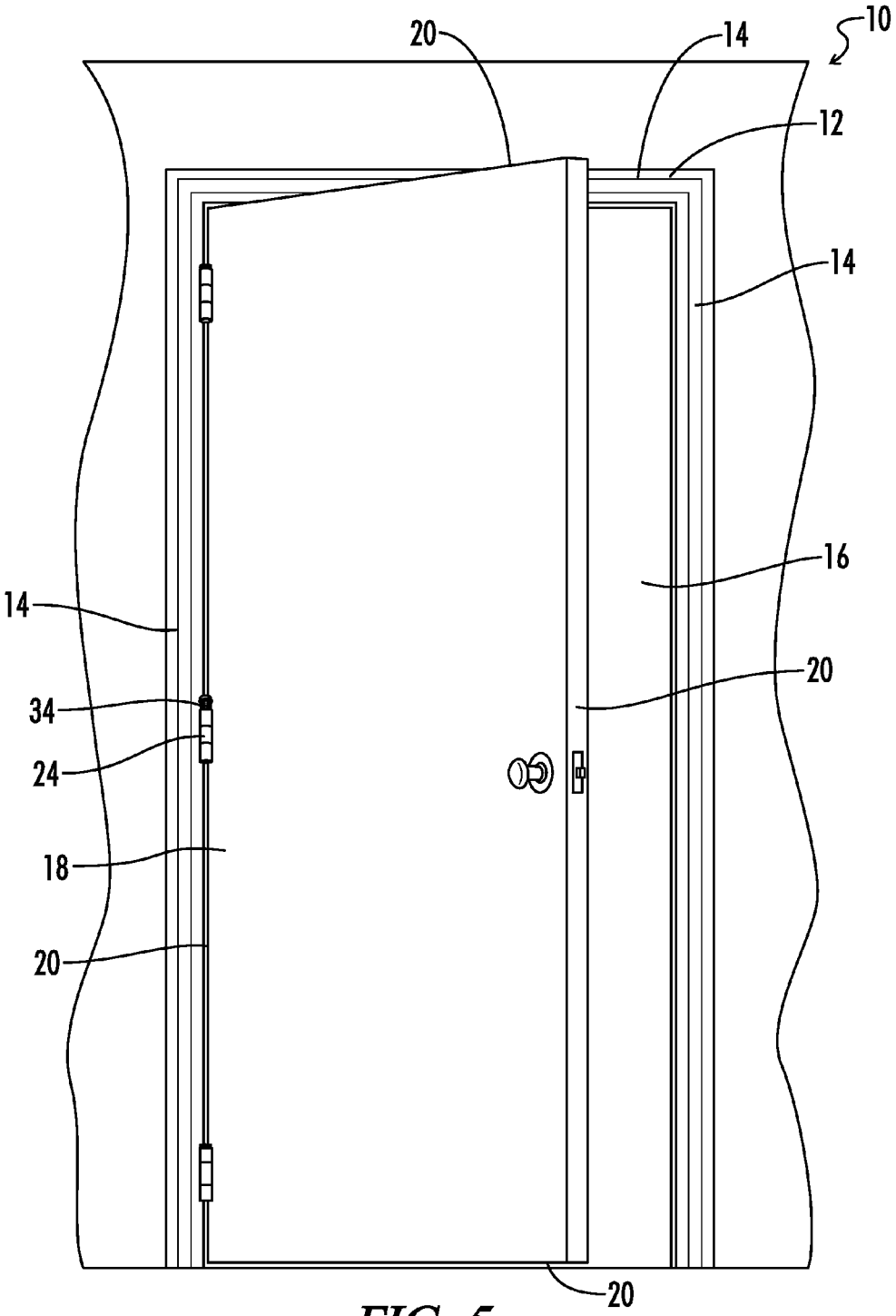
FIG. 5 illustrates a side perspective view of the door opener system of FIG. 2.
Figure 6:
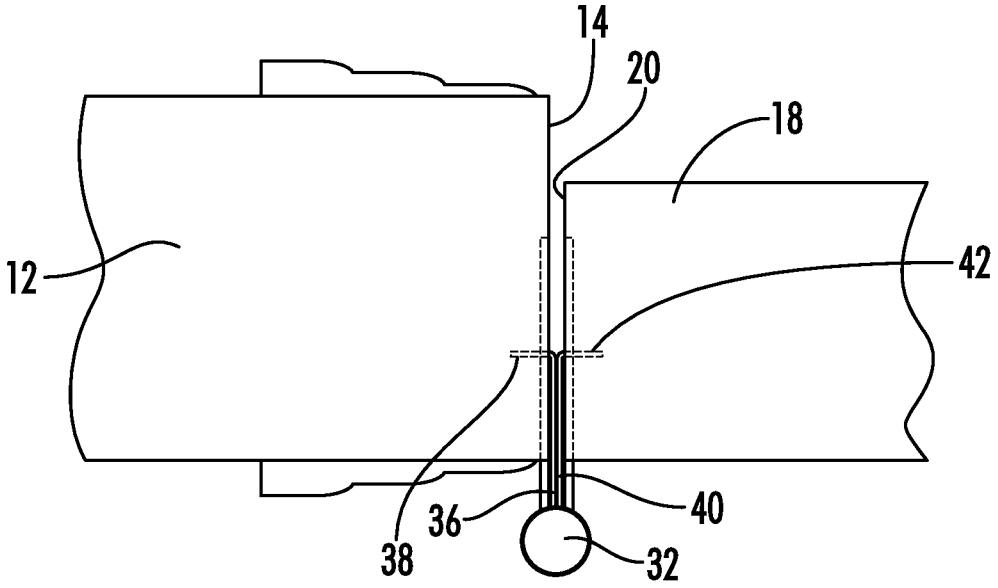
FIG. 6 illustrates a top plan view of the door opener system of FIG. 2.

In the case of a door 18 with several hinges 24, such as that shown in FIG. 5, a torsion spring 34 may be placed above one or more of the hinges. Preferably, the torsion spring 34 is placed above at least the middle hinge 24, as shown in FIG. 5.

The door opener system 10 may be used in a method that includes, for example: a) providing the door frame 12; b) providing the door 18; c) providing the door hinge 24; d) removing the pivot pin 32 from the door hinge 24; e) providing the torsion spring 34; f) inserting the pivot pin 32 through the aperture 59 created by the coil loops/runs 50A-50D and into the pivot pin aperture 30; and g) forcing the distal segment 42 of the distal leg 39 into a side 20 of the door 18 adjacent to the door plate 26 (by, for example, hammering) and forcing the proximal segment 38 of the proximal leg 35 into the door frame 12 adjacent to the frame plate 28 (by, for example, hammering).

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

What is claimed is:

1. A method of urging a door into the open position comprising:

a) providing a door frame comprising a plurality of sides and a door opening located between the plurality of sides;

b) providing a door comprising a plurality of sides, the door configured to pivot along a pivot axis from a closed position in which the door covers the door opening to an open position in which the door does not cover the door opening;

c) providing a door hinge comprising a door plate attached to a side of the door, a frame plate attached to a side of the frame adjacent to the door plate when the door is in the closed position, a pivot pin aperture located between the door plate and the frame plate, and a pivot pin removably inserted through the pivot pin aperture, the pivot pin and pivot pin aperture generally parallel to the pivot axis;

d) removing the pivot pin from the pivot pin aperture;

e) providing a torsion spring comprising a proximal leg comprising a proximal segment and a distal segment, a distal leg comprising a proximal segment and a distal segment, and a coil located between the proximal segment of the distal leg and the distal segment of the proximal leg, the coil comprising a plurality of runs, the plurality of runs creating an aperture, the proximal segment of the proximal leg forming approximately a 90 degree angle with the respect to the distal segment of the proximal leg, the distal segment of the distal leg forming approximately a 90 degree angle with respect to the proximal segment of the distal leg, the torsion spring having a relaxed state and a compressed state;

f) inserting the pivot pin through the aperture created by the plurality of runs and into the pivot pin aperture; and g) forcing the distal segment of the distal leg into the door adjacent to the door plate and forcing the proximal segment of the proximal leg into the door frame adjacent to the frame plate.

2. The method of claim 1, wherein the proximal segment of the proximal leg and the distal segment of the distal leg point in generally the same direction when the torsion spring is in the relaxed state.

3. The method of claim 1, wherein the proximal and distal segments of the proximal leg and the proximal and distal segments of the distal leg are generally straight.

4. The method of claim 3, wherein the proximal segment of the proximal leg is shorter than the distal segment of the proximal leg and further wherein the distal segment of the distal leg is shorter than the proximal segment of the distal leg.

5. The method of claim 1, wherein the proximal segment of the proximal leg and the distal segment of the distal leg point in opposite directions when the door is in the closed position.

6. The method of claim 1, wherein step g) comprises hammering the distal segment of the distal leg into the side of the door attached to the door plate and hammering the proximal segment of the proximal leg into the side of the door frame attached to the frame plate.

7. The method of claim 1, wherein step g) comprises forcing the distal segment of the distal leg into the door above the door plate and forcing the proximal segment of the proximal leg into the door frame above the frame plate.

8. The method of claim 1, wherein the coil is generally cylindrical in shape.

9. The method of claim 1, wherein the torsion spring is comprised of a continuous piece of metal wire from the proximal segment of the proximal leg to the distal segment of the distal leg.

10. The method of claim 9 wherein the continuous piece of metal wire has a diameter of from about 0.045 inches to about 0.065 inches.

11. The method of claim 1, wherein the torsion spring comprises a length of between about 2 inches and about 3 inches.

12. The method of claim 1, wherein the torsion spring is comprised of a continuous piece of tempered spring wire from the proximal segment of the proximal leg to the distal segment of the distal leg, the continuous piece of tempered spring wire having a length of from about 4 inches to about 7 inches.

13. The method of claim 1, wherein after step g), the torsion spring is configured to bias the door in the open position.

14. The method of claim 1, wherein after step g), the torsion spring is in the compressed state when the door is in the closed position.

15. The method of claim 1, further comprising providing a washer comprising a washer aperture, the washer aperture comprising a diameter, and step f) comprises inserting the pivot pin first through the washer aperture, then through the aperture created by the plurality of runs and then into the pivot pin aperture.

16. The method of claim 15, wherein the washer aperture is generally circular in shape and has a diameter, the aperture created by the plurality of runs is generally circular in shape and has a diameter and further wherein the diameter of the washer aperture is less than the diameter of the aperture created by the plurality of runs.

17. The method of claim 1, wherein the aperture created by the plurality of runs has a diameter of between about 0.5 and about 0.75 inches.

18. The method of claim 1, wherein the torsion spring comprises a top run, a bottom run, a height extending from the top run to the bottom run, and further wherein one of the proximal and distal legs extends from the top run and the other of the proximal and distal legs extends from the bottom run.

* * * * *